US009695031B2

(12) United States Patent
Whittard

(10) Patent No.: US 9,695,031 B2
(45) Date of Patent: Jul. 4, 2017

(54) BEVERAGE DISPENSING ARRANGEMENT

(71) Applicant: SOUTHPOUR PTY LTD, Victoria (AU)

(72) Inventor: John Whittard, Victoria (AU)

(73) Assignee: SOUTHPOUR PTY LTD, Victoria (AU)

( * ) Notice: Subject to any disclaimer, the term of this patent is extended or adjusted under 35 U.S.C. 154(b) by 23 days.

(21) Appl. No.: 14/780,661

(22) PCT Filed: Mar. 28, 2014

(86) PCT No.: PCT/AU2014/000332

§ 371 (c)(1),
(2) Date: Sep. 28, 2015

(87) PCT Pub. No.: WO2014/153615

PCT Pub. Date: Oct. 2, 2014

(65) Prior Publication Data

US 2016/0052771 A1 Feb. 25, 2016

(30) Foreign Application Priority Data

Mar. 28, 2013 (AU) ..... 2013100382

(51) Int. Cl.
*B65B 37/00* (2006.01)
*B67D 1/08* (2006.01)
(Continued)

(52) U.S. Cl.
CPC ..... *B67D 1/0894* (2013.01); *B67D 1/0081* (2013.01); *B67D 1/06* (2013.01);
(Continued)

(58) Field of Classification Search
CPC .. B67D 1/0894; B67D 1/0083; B67D 1/1477; B67D 1/06
See application file for complete search history.

(56) References Cited

U.S. PATENT DOCUMENTS 4,448,036 A 5/1984 Iannelli
5,390,714 A * 2/1995 North, III ..... B67D 1/06 141/165

FOREIGN PATENT DOCUMENTS

BR PI0904124-9 A2 2/2012
DE 3441909 A1 5/1986
(Continued)

OTHER PUBLICATIONS

Haskayne, Paul, Pump Up Your Volume, catalogue, Jul. 2012, 1-41, Lancer Europe, Cheshire, United Kingdom.
(Continued)

*Primary Examiner* — Jason K Niesz
(74) *Attorney, Agent, or Firm* — Levenfeld Pearlstein, LLC

(57) ABSTRACT

A beverage dispensing arrangement (10) for dispensing beverage into beverage cups (25) that are secured within a beverage cup carrying container (19). The arrangement (10) includes a dispensing bench (11) on which the cup and carrying container assembly (19) can be supported at a beverage dispensing assembly (20) for dispensing beverage into the cups (25) of the assembly (19). The assembly (20) includes at least two dispensing taps (28, 30) that are spaced apart relative to the spacing of the cups (25) of the container (19) to overlie the open ends of the cups (25) when the container assembly (19) is placed in a beverage receiving position.

16 Claims, 10 Drawing Sheets

(51) Int. Cl.

| | |
|---|---|
| ***B67D 1/06*** | (2006.01) |
| ***B67D 1/14*** | (2006.01) |
| ***B67D 1/00*** | (2006.01) |

(52) U.S. Cl.
CPC ..... *B67D 1/0888* (2013.01); *B67D 1/1477* (2013.01); *B67D 2210/00068* (2013.01)

(56) References Cited

FOREIGN PATENT DOCUMENTS

| | | |
|---|---|---|
| GB | 2301340 A | 12/1996 |
| GB | 2313357 A | 11/1997 |

OTHER PUBLICATIONS

International Search Report and Written Opinion of International Search Authority in PCT/AU2014/000332 dated Apr. 29, 2014.
International Preliminary Report on Patentability (Chapter II) in PCT/AU2014/000332 dated Jul. 22, 2015.
European Search Report issued by EPO in connection with EP14772741 on Dec. 2, 2016.

* cited by examiner

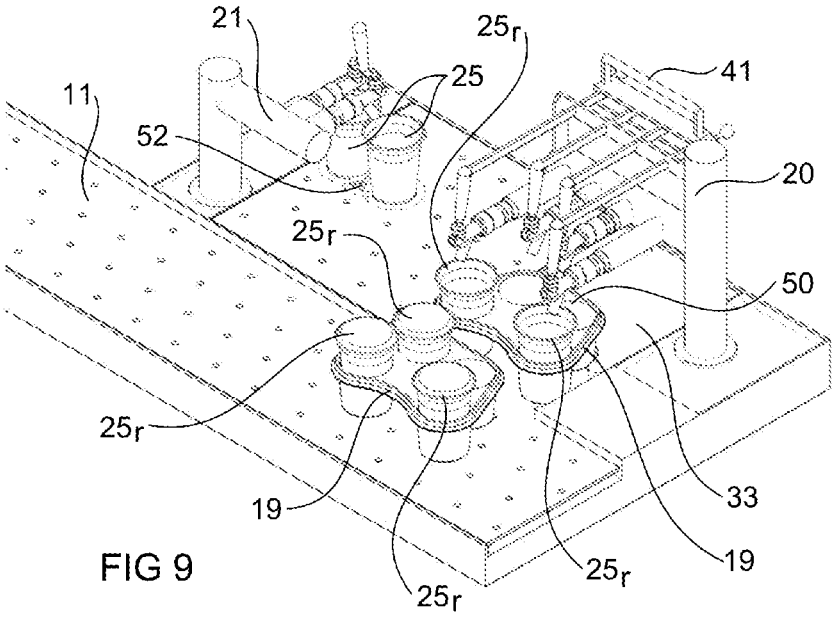
FIG 9
FIG 10
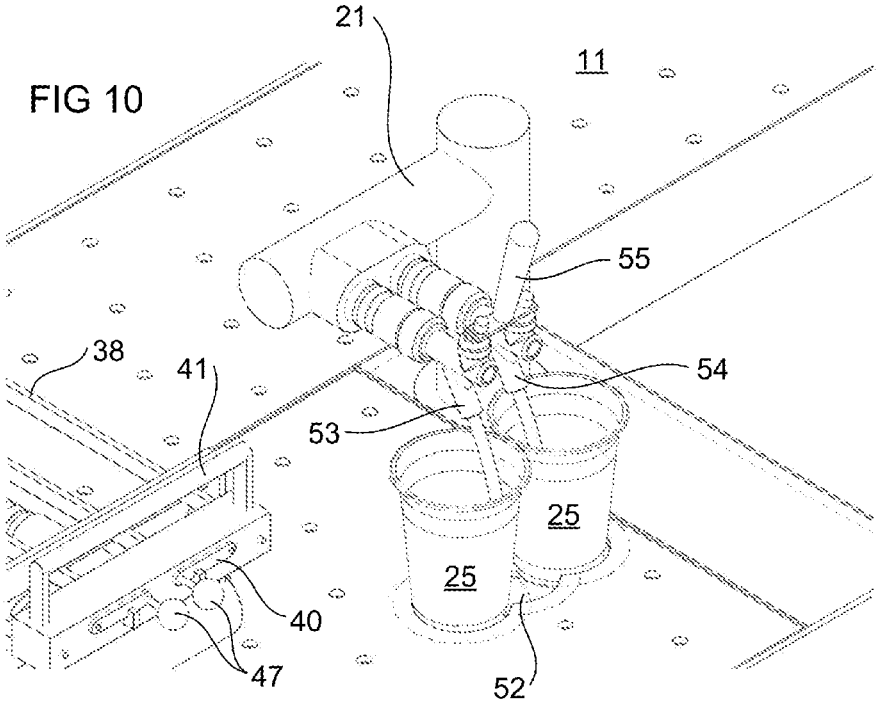

BEVERAGE DISPENSING ARRANGEMENT

TECHNICAL FIELD

The present invention relates to beverage dispensing equipment and arrangements and has been developed principally for use in venues requiring high speed dispensing, such as sporting venues, concert venues, exhibition halls and like venues in which fast delivery of beverages is desirable to accommodate large crowds that attend such venues.

BACKGROUND OF THE INVENTION

Service of beverages to patrons attending venues of the above kind can be problematic given the large numbers of patrons often in attendance and the need to serve patrons during short periods of time. In this respect, it is often the cases that, particularly during sporting events, the major sales of beverages occurs close to the start of play, as well as during breaks in play in which patrons leave their seats to use the amenities of the venue. Thus, during these times, patrons will often visit the food and beverage amenities to purchase food and/or beverage. The breaks in particular can be quite short in many sports, such as for 10 or 15 minutes only. For example, three breaks occur during a game of Australian Rules Football and these consist of two approximately 6 minute breaks and a main 20 minute break.

In many venues, beverage cups are filled individually by hand-operated beverage dispensers. These dispensers are relatively cheap, but they operate very slowly and during peak demand can impede the delivery of beverages significantly. One of the difficulties associated with slow delivery of beverages is that it tends to reduce the sale of beverages and so have an impact on venue profitability. Patrons do not want to spend time in queues, particularly when the venue event is underway, while patrons often use the scheduled breaks in events for socialising purposes and when faced with a long wait for beverage service will often decide to go without.

To speed up the delivery of beverages to patrons, a greater number of staff can be used with a greater number of beverage dispensers. However, this increases staff costs and given that the major problem with the speed of beverage delivery exists only before the event commences and during the breaks that occur during an event, the greater number of staff can often be under-utilised other than during those times.

Because of the limited time in which to serve large numbers of patrons, semi-automatic beverage dispensers have been developed which operate to fill beverage cups in advance of the purchase of those cups. Thus, beverage dispensers are available that will fill a large tray of beverage cups, for example that might include four rows of four cups and once all the cups of the tray are full of beverage, the tray can be shifted to a position at which the dispense operator can remove the cups from the tray or customers can take the desired number of cups from the tray for purchase. This form of tray is only for use in the filling procedure and is returned for restacking with unfilled beverage cups once all of the filled cups have been removed.

Beverage carriers or cup carrying containers have been made available at venues that allow individual customers to carry up to four filled beverage cups at one time with relative ease and in a way that the cups are kept relatively stable. Some of these cup carrying containers allow up to four cups to be carried by one hand. Where these cup carrying containers are used with existing beverage dispensers, the customer takes the filled beverage cup from the filling or service point and loads it into the cup carrying container. For example, the customer lifts the required number of cups out of the tray of the semi-automatic beverage dispenser described above and loads them into the cup carrying container and then proceeds to the counter for payment.

While the use of cup carrying containers enables the carriage of a plurality of filled beverage cups with relative stability, their use requires the service personnel or the customer to load the filled beverage cups into the cup carrying container from the dispensing tray, or dispensing surface or service counter, on which the beverage cups are filled. Because beverage cups are usually filled to the cup rim, the loading process can result in spillage. This is particularly relevant to the use of semi-automatic beverage dispensers, as the cups have to be lifted out of the tray and the lifting process can exacerbate spillage unless the loading process is carried out slowly and carefully. In the case of the purchase of four beverages, the customer must load each of the filled beverage cups individually into the cup carrying container before lifting the container to move away from the beverage dispenser and out of the path of other customers. Thus, time is taken for loading the cup carrying container that can slow the process of serving beverages to customers and while that time is only small for each customer, during peak demand, the loading time can be such overall delays are significant resulting in lost beverage sales.

Also, the process of loading the beverages from the dispensing tray or dispensing surface can be unhygienic given that the beverage cups are normally grasped by the drinking rim for loading into a beverage carrier, which means that the rim can be contaminated with germs that can later come into contact with the lips of the consumer. Also, that kind of handling often means that either the dispense operator or the customer's finger tips touch the liquid within the cup which is to be drunk by someone other than the dispense operator or the customer. In that case, the experience can be unpleasant for both the serving personnel and customer because either is left with wet and/or sticky hands/fingers and there are obvious issues in terms of the transmission of germs.

It is an object of the present invention to provide beverage dispensing equipment or arrangements which overcomes or at least alleviates one or more of the foregoing disadvantages.

SUMMARY OF THE INVENTION

The present invention provides a beverage dispensing arrangement for dispensing beverage into beverage cups that are secured within a beverage cup carrying container and which form a cup and carrying container assembly, the arrangement including a dispensing bench on which a cup and carrying container assembly can be supported, a beverage dispensing assembly for dispensing beverage into the cups of a cup and carrying container assembly and including at least two dispensing taps that are to overlie the open ends of the cups when the cup and carrying container assembly is placed in a beverage receiving position, the beverage dispensing arrangement having an operator side and a customer side which are on opposite sides of the dispensing arrangement, the beverage dispensing arrangement being such that a customer has access to the beverage receiving position from the customer side and upon placement of the cup and carrying container assembly in the beverage receiving position an operator is able to operate the dispensing taps from the operator side to dispense beverage into the cups of the cup and carrying container assembly, for removal by the customer upon the cups of the cup and carrying container assembly being filled.

A beverage dispensing arrangement according to the invention advantageously has been developed for use with a pre-filled cup carrying container so that once the cups of the cup and carrying container assembly have been filled with beverage, the customer can remove the cup and carrying container assembly without further manipulation of the filled beverage cups and without the dispense operator needing to touch or handle the beverage cups or the cup and carrying container assembly. This improves the speed of delivery of beverages and the hygiene relating to their delivery.

The present invention also provides a beverage dispensing assembly for the beverage dispensing arrangement described above.

The present invention further provides a method of dispensing beverage in beverage cups, the method including placing at least two cups in a handheld beverage cup carrying container to form a cup and carrying container assembly, placing the cup and carrying container assembly in a beverage receiving position relative to a beverage dispensing arrangement, the beverage dispensing arrangement including at least two dispensing taps that are spaced apart to overlie the open ends of the beverage cups of the cup and carrying container assembly when the cup and carrying container assembly is in the beverage receiving position, activating the beverage dispensing arrangement to dispense beverage into the beverage cups of the cup and carrying container assembly and, upon the beverage cups being filled, removing the cup and carrying container assembly from the beverage dispensing arrangement.

Significant advantages flow from the present invention as broadly described and as described in the form which employs an operator side and a customer side. In particular, because a customer has access to the beverage receiving position from the customer side of the beverage dispensing arrangement, the customer can remove the cup and carrying container assembly from the beverage receiving position after completion of the delivery of beverage from the dispensing taps of the beverage dispensing assembly. In some forms of the invention, the customer can also place the cup and carrying container assembly in the beverage receiving position. Thus, regardless of who places the cup and carrying container assembly in the beverage receiving position, the person who touches the cup and carrying container assembly once the cups of the container are filled is the customer and not the dispense operator of the beverage dispensing arrangement. This is different to some of the prior art in which the dispense operator handles the beverage cups during filling and subsequent service to the customer and therefore has these forms of the invention have hygiene advantages.

Moreover, because the beverage cups are filled when they are already secured in the beverage cup carrying container, once the cups are filled, they can be removed from the beverage dispensing arrangement by the customer in the carrier and without further manipulation. Thus, there is no need for manipulation of individual beverage cups from the beverage receiving position into a carrying container and this can reduce the likelihood of beverage spillage from the beverage cups.

Both of the above advantages provide hygiene improvements, given that dispense operators no longer come into contact with the filled beverage cups or the beverage poured into the cups, while the reduction in spillage at the beverage dispensing arrangement increases the cleanliness of the site of the arrangement.

In some forms of the invention, the beverage dispensing assembly includes four taps, which can be arranged side by side, and which form a pair of outside taps and a pair of inside taps. In these forms of the invention, for certain types of beverage cup carrying containers, the outside taps can be positioned closer to the customer side of the beverage dispensing arrangement than the inside taps. The space inbetween the four taps can be the same, or an unequal spacing can be adopted. For example, the taps can be formed into pairs of taps with each pair comprising a outside and inside tap. In that arrangement, each of the taps in each pair of taps can be close together, while the pairs of taps themselves can be spaced well apart.

Regardless of the number of taps of the beverage dispensing assembly, one or more of the taps can be selectively disabled, so that less than all of the taps can be used to dispense beverage. Thus, where the beverage dispensing assembly includes four taps, the arrangement can be that two of the taps can be selectively disabled so that of the four taps, beverage can be selectively dispensed from two, three or four of the taps. The manner in which the taps are disabled can be by any suitable arrangement, such as manual deactivation (as will be described later herein), or by electronic activation, such as solenoid valve activation. In this latter arrangement, the beverage dispensing arrangement might include a panel which allows the dispense operator to select the taps through which beverage will flow for each cup and carrying container assembly that is presented at the beverage receiving position. This advantageously allows customers to present different numbers of cups in a carrying container and the cups still be filled by the present invention.

In one form of the invention, the dispensing taps each include a handle which operates a valve in each tap to open or close the tap for the flow of beverage. In order to actuate the handles, such as from the operator side of the beverage dispensing arrangement, each handle is connected by a rod to a manifold which is moveable, such as away from and back towards the operator side. Accordingly, movement of the manifold towards the customer side (a forward direction) moves each of the rods forward to actuate the handles of the taps to thus open the tap valves to dispense beverage from the taps. Movement of the manifold away from the customer side (a rearward or return direction) moves each of the rods rearward to actuate the handles of the taps to thus close the tap valves to terminate dispensing of beverage from the actuated taps. Similar arrangements can be employed in forms of the invention which do not employ the operator and customer sides of the beverage dispensing arrangement.

In the above arrangement, selective disablement of one or more of the taps can be achieved by making one or more of the rods disengageable from the manifold. By this arrangement, if a rod is disengaged from the manifold, forward movement of the manifold, for example in the direction of the customer side will move those rods which have not been disabled but not the rod or rods that have been disabled.

In arrangements of the invention in which the beverage dispensing assembly includes four dispensing taps, the rods that extend from two of the taps can be disengageable from the manifold, and the disengagement can be separate, so that the beverage dispensing assembly can be selected to dispense beverage from two, three or four taps.

While it has been discussed above that the beverage dispensing assembly has at least two taps, the preferred arrangements of the invention include that the assembly includes three, four, five or six taps.

A second beverage dispensing assembly can also be provided for dispensing beverages. This is advantageous for customers who wish only to purchase one or two beverages and are comfortable to carry the beverage cups by hand. Thus, the second beverage dispensing assembly can be used to fill one or two cups. It is preferred that the second beverage dispensing assembly include two taps which are spaced apart an amount so that where a single cup is to be filled, both taps overlie the opening of the single cup and can pour into the single cup, or where two beverage cups are to be filled, each of the taps can overlie a respective cup.

To assist the location of one or two beverage cups in a beverage receiving position proximate the second beverage dispensing assembly, the dispensing bench can include a recess to locate the base of the cups. The recess thus can locate two cups adjacent one another, or a single cup centrally of the position of the two cups. The recess can be formed of an indentation or depression in the dispensing bench or it can be formed by upstanding projections that are upstanding from the dispensing bench or a lip or flange that is upstanding from the dispensing bench. Other arrangements could apply.

Returning to the first beverage dispensing assembly, this can include an abutment so that the cup and carrying container can abut the abutment in the beverage receiving position. The advantage of the abutment is that the dispense operator or the customer who places the cup and carrying container assembly on the dispensing bench can push the container to the position of abutment and thereafter know that the cup and carrying container assembly is correctly located for filling of the beverage cups.

In some forms of the invention, the abutment can be moveable, such as from the operator side, so that upon the cups of the cup and carrying container assembly being filled with beverage, the dispense operator can shift the abutment towards the customer side, which pushes the cup and carrying container in the same direction so that the customer can readily grasp the cup and carrying container assembly for removal. This arrangement also provides the dispense operator with control over when the customer can remove the cup and carrying container. That is, once the dispense operator has filled the beverage cups, the abutment can be shifted in the forward direction, or in a direction towards the customer, or in a direction towards a pick-up position, identifying to the customer that the cup and carrying container assembly can now be removed.

Guide surfaces can be provided separate to or in addition to the abutment referred to above so that further positive location of the cup and carrying container assembly is provided. The guide surfaces can be arranged separate to or in addition to the abutment discussed above and can be formed as side edges of a recess of the dispensing bench. As with the recess discussed above, the side edges can be formed by upstanding projections that are upstanding from the dispensing bench or a lip or flange or lips or flanges that are upstanding from the dispensing bench. Other arrangements could apply.

The guide surfaces can be arranged to engage against bottom ends of the cup and carrying container assembly. The bottom ends of a cup and carrying container assembly can be the bottom ends of the cups of the assembly, or the bottom ends of receptacles into which the cups are received.

The beverage dispensing arrangement can be provided as a unit which is mobile or portable and which can be assembled on a bench top. Alternatively, the arrangement can include a cabinet on which the dispensing bench and dispensing assemblies are supported. The cabinet can be a portable cabinet, or a fixed cabinet.

BRIEF DESCRIPTION OF THE DRAWINGS

In order that the invention may be more fully understood, some embodiments will now be described with reference to the figures in which:

FIG. 9 is a similar view as FIG. 8 with a second beverage dispensing cup in place.

FIG. 10 shows the second beverage dispensing assembly in a pouring mode with two beverage cups being filled.

DETAILED DESCRIPTION OF THE DRAWINGS

Figure 1:
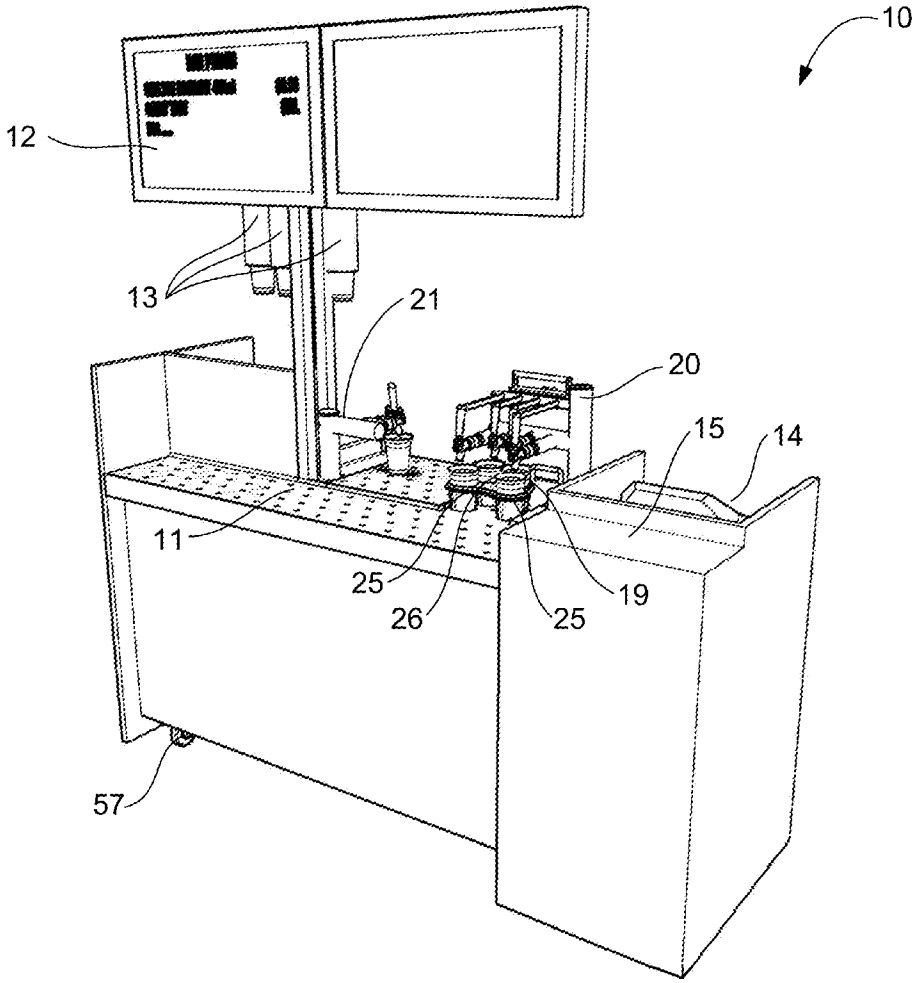
FIG. 1 is a perspective view from the customer side of a beverage dispensing arrangement according to one embodiment of the invention.
Figure 2:
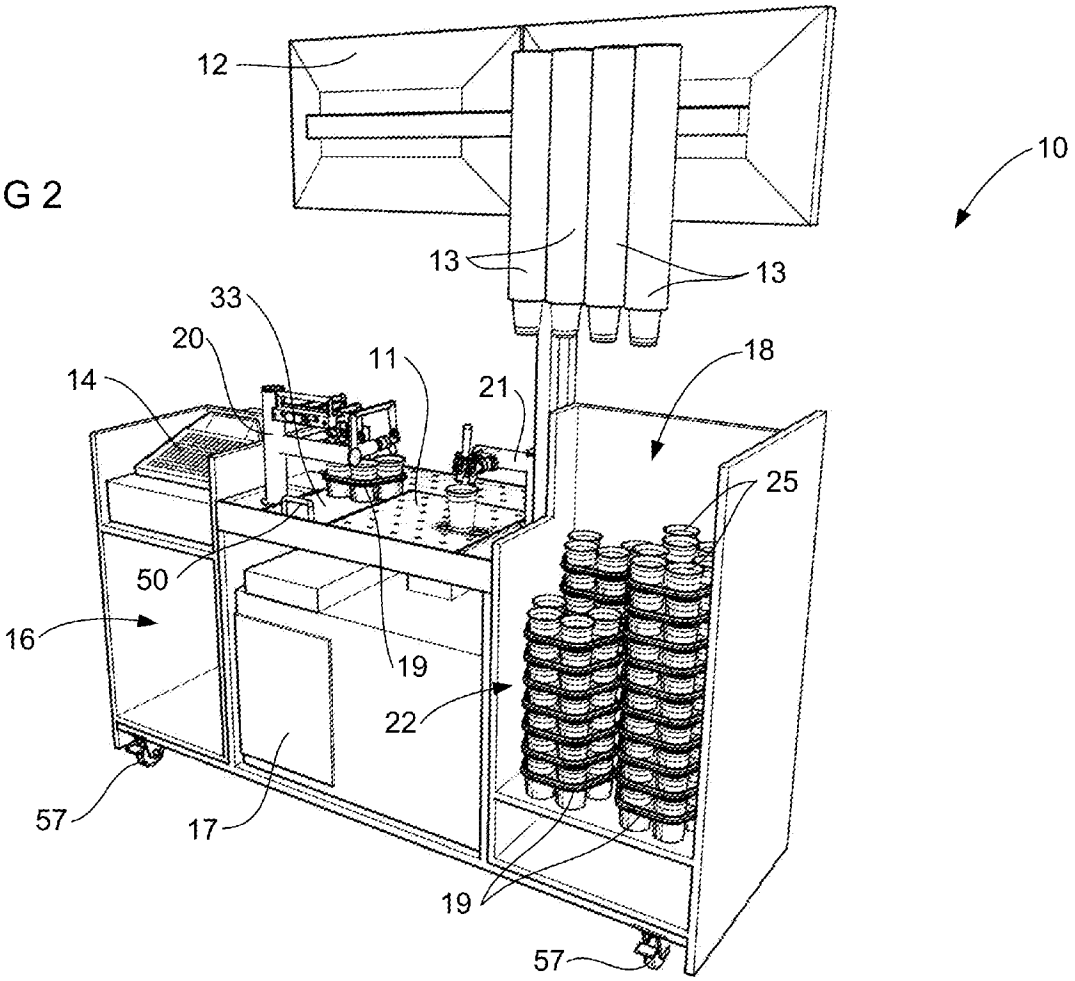
FIG. 2 is a perspective view of the beverage dispensing arrangement of FIG. 1 from the operator side.

FIGS. 1 and 2 show front and rear images of a beverage dispensing arrangement 10 according to the invention. The beverage dispensing arrangement 10 is a dispensing arrangement for dispensing beer, but it will be appreciated that it could dispense other beverages or a mixture of beverages. Much of the beverage dispensing arrangement 10 is part of the prior art but for completeness of description, the prior art components of the beverage dispensing arrangement 10 will be described in addition to the components that form the present invention.

The dispensing arrangement 10 includes an approximately L-shaped dispensing bench 11 which is perforated to allow beverage spillage to penetrate through the upper surface of the bench 11 and into a reservoir area below the upper surface. The dispensing bench 11 can empty to a suitable drain, or it can be manually emptied as it fills with beverage spillage.

The beverage dispensing arrangement 10 further includes overhead signage, TV screens or monitors 12, that can be used for advertising beverage prices or for other relevant advertisements or information. Behind the signage 12 is a plurality of beverage cup dispensing tubes 13. The tubes 13 can be filled with beverage cups (not shown) which feed towards the bottom end of the tubes 13 and the beverage cups can be pulled out of the tubes from the bottom of the tubes.

The arrangement 10 further includes a cabinet, which includes a space for a point of sale cash register 14, a transaction counter 15, a storage area 16, a beverage cooler area for housing a large capacity beverage cooler 17 for cooling the beverage, and a stock area 18 in which beverage cup and carrying container assemblies 19 can be stacked.

The configuration of the beverage dispensing arrangement 10 is not unusual, but has been customised to facilitate use of the present invention. However, it should be appreciated that various other configurations could easily be adopted which employ the present invention.

The arrangement 10 further includes separate beverage dispensing assemblies 20 and 21. The assembly 20 is a four tap assembly, while the assembly 21 includes two taps. The respective assemblies 20 and 21 can be used separately and independently of each other as will be explained hereinafter.

The present invention has been developed to utilise the convenience of handheld beverage cup carrying containers of the kind illustrated in FIGS. 1 and 2. With reference to FIG. 1, the container 19 includes openings for four beverage cups 25 with the arrangement having two front cups and two rear cups. The container 19 includes a central area 26 with which a customer grips the container 19, typically with the customer's thumb on the upper surface of the container 19 and the fingers on the opposite and underneath side. Containers of the kind illustrated in FIGS. 1 and 2 are now used in sporting and other event venues to conveniently allow a customer to single-handedly carry four filled beverage cups, such as from the beverage outlet back to their seat. The design of such carrying containers has improved in terms of the stability with which beverage cups can be carried to the point where despite the weight of four filled beverage cups, the carrying container can keep the cups level so that with care, the likelihood of spillage during carriage of the container and beverage cups is low.

Currently, a customer would purchase a beverage cup carrying container and load the beverage cups into the container once they are filled. The prior art includes large trays of beverage cups that are filled at semi-automatic filling stations by a dispense operator who then moves the trays to a serving bench or counter and the customer or the dispense operator would normally lift beverage cups out of the tray and then the beverage cups would be loaded into the carrying container. Alternatively, filled beverage cups would be lifted by the dispense operator and assembled on a service bench or counter and the customer would take the cups from the counter and load them into the carrying container. After the carrying container has been loaded, the customer would then normally pick up the carrying container and move to the point of sale register to pay for the beverages usually requiring that carrying container be temporarily set down to free the customer's hands for the transaction. Once having paid, the customer would pick up the carrying container again and walk away, such as back to his or her seating. Thus, the customer is required to lift the beverage cups once filled into the carrying container before moving away from the dispensing arrangement.

In contrast to the prior art, the method of the present invention is to fill the beverage cups when they are part of an assembly comprising the carrying container and the beverage cups (a cup and carrying container assembly) in order to provide efficiency gains in the rate of delivery of beverages to customers, so that customers can be served more quickly to provide greater customer satisfaction and potentially increased beverage sales and potentially savings in personnel expenditure.

Moreover, the invention allows for customers to order and pay at the transaction counter 15 and the dispense operator will eavesdrop on that transaction taking place between the cashier and the customer (or be instructed by the cashier) so that the dispense operator can begin pouring beverages while transaction is being completed, thereby minimizing further the overall time to fulfil the transaction.

A benefit of the pre-payment system described above is that the customer is paying before he/she has their hands full carrying the cup and carrying container assembly 19/25.

In accordance with the invention, beverage cups 25 are preloaded into carrying containers 19 and a stack of such cup and carrying container assemblies 22 are placed in the stack area 18 of the beverage dispensing arrangement 10. The preloading is optional and in an alternative arrangement, the carrying containers 19 are loaded as the customer approaches the arrangement 10 and indicates the number of beverages to be purchased. Also, while the stack of assemblies 22 is of the beverage dispensing arrangement 10 is shown accessible from the operator side of the arrangement 10, the stack could alternatively be accessible from the front or customer side of the arrangement 10.

Figure 3:
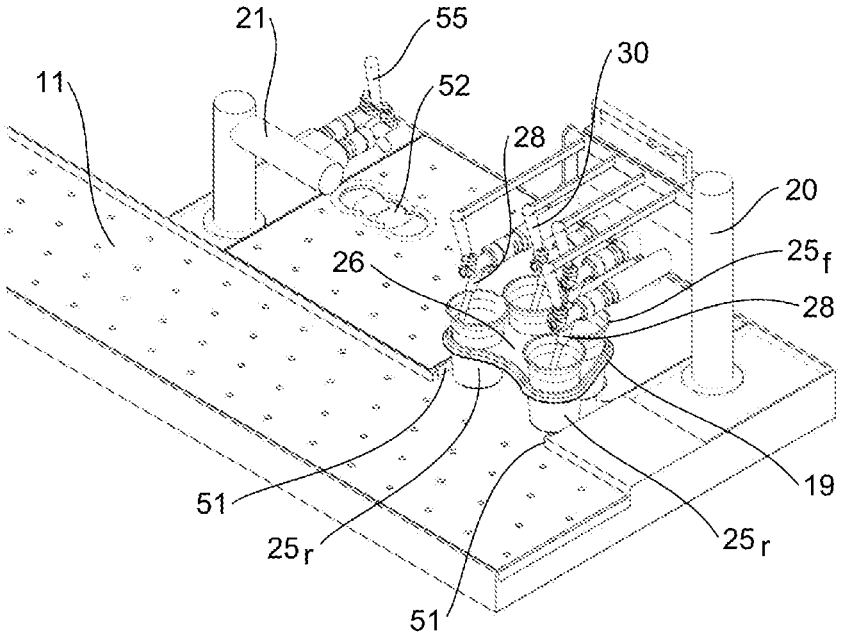
FIG. 3 is a perspective view of a portion of the beverage dispensing arrangement of FIGS. 1 and 2.

When a customer wants to purchase two or more beverages, the dispense operator can pick up a cup and carrying container assembly 22 and place the assembly 22 in position relative to the dispensing taps 28 and 30 of the assembly 20 and can then activate the taps 28 and 30 depending on the number of beverage cups that need to be filled. For example, where the assembly 22 includes four beverage cups 25, all four of the dispensing taps 28 and 30 of the assembly 20 can be activated. That arrangement is illustrated in FIG. 3, where beverage is shown being dispensed from each of the four dispensing taps 28 and 30.

Alternatively, the customer may load only two beverage cups 25 or three beverage cups 25 into the assembly 22, and under those circumstances, a reduced number of the dispensing taps 28 and 30 could be activated.

However, regardless of the number of dispensing taps to be activated, the beverage cups 25 are filled having been already inserted into an assembly 22. Accordingly, once the beverage cups 25 are filled, the customer or the dispense operator can simply move the assembly 22 from under the dispensing taps 28 and 30 and can lift the container 19 with the filled beverage cups 25. As explained above, if the dispense operator has poured the beverages while the customer is paying, once the beverage cups 25 are filled, the customer can simply take the container 19 away.

There is no requirement for the beverage cups to be lifted and placed into the container 19, as they are already assembled into the container 19 prior to the beverage cups being filled. Accordingly, a step of the prior art is removed by the present invention and even though that step might be a step of short timeframe, when multiplied over numerous customers, significant time savings are expected.

A more detailed explanation will now be made in relation to the operation of the invention.

Figure 4:
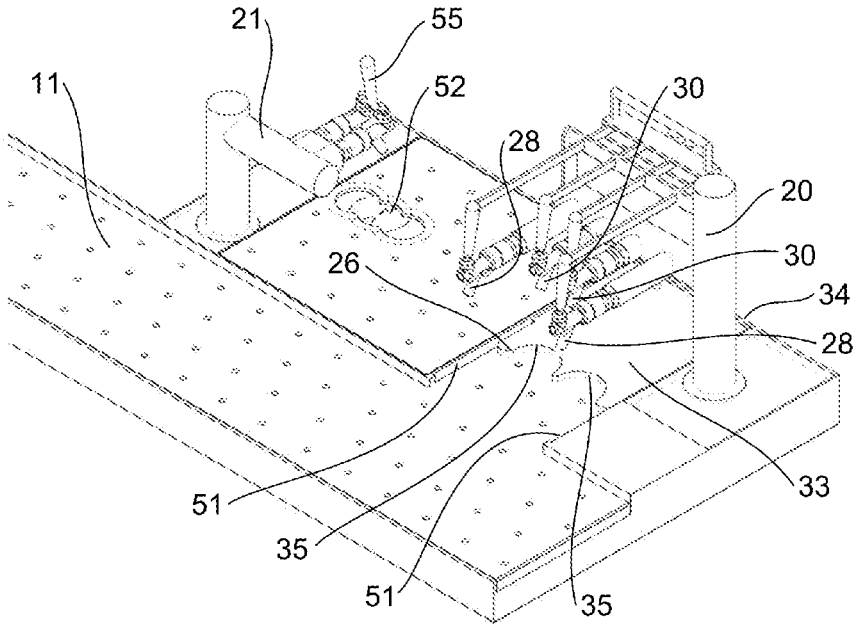
FIG. 4 is a view of the beverage dispensing assemblies illustrated in FIGS. 1 and 2.

FIG. 4 shows the arrangement of FIG. 3 but without the assembly 22 in place. It can be seen in FIG. 4, that a template 33 rests on the dispensing bench 11 bearing against an upstanding lip 34 of the bench to prevent movement of the template 33. The template 33 has a pair of concave inserts or indentations 35 adjacent to one another at the leading end of the template that define an abutment. The inserts 35 are shaped to receive the bottom portions of the front of the assembly 22 of FIG. 3. The template 33 advantageously forms an abutment that allows the assembly 22 to be correctly positioned relative to the beverage dispensing assembly 20 so that the taps 28 and 30 correctly overlie the open ends of the beverage cups 25. Thus a customer wanting to fill two or more beverage cups 25 needs merely to push the assembly 22 into the position in which the bottom portions of the assembly 22 engages within the inserts 35 and the assembly 22 is then correctly positioned. Thus, the assembly 22 can be quickly and correctly positioned by this method. As indicated earlier, the bottom ends of the assembly 22 can be the bottom ends of the cups 25 of the assembly, or the bottom ends of receptacles into which the cups are received.

Once correctly positioned, the dispensing taps 28 and 30 can be actuated to deliver beverage to the beverage cups 25. In the arrangement illustrated, a linkage or articulated link assembly is shown by which all of the taps 28 and 30 can be actuated or alternatively, the taps 30 can be disabled from operation where just the taps 28 are required.

Figure 5:
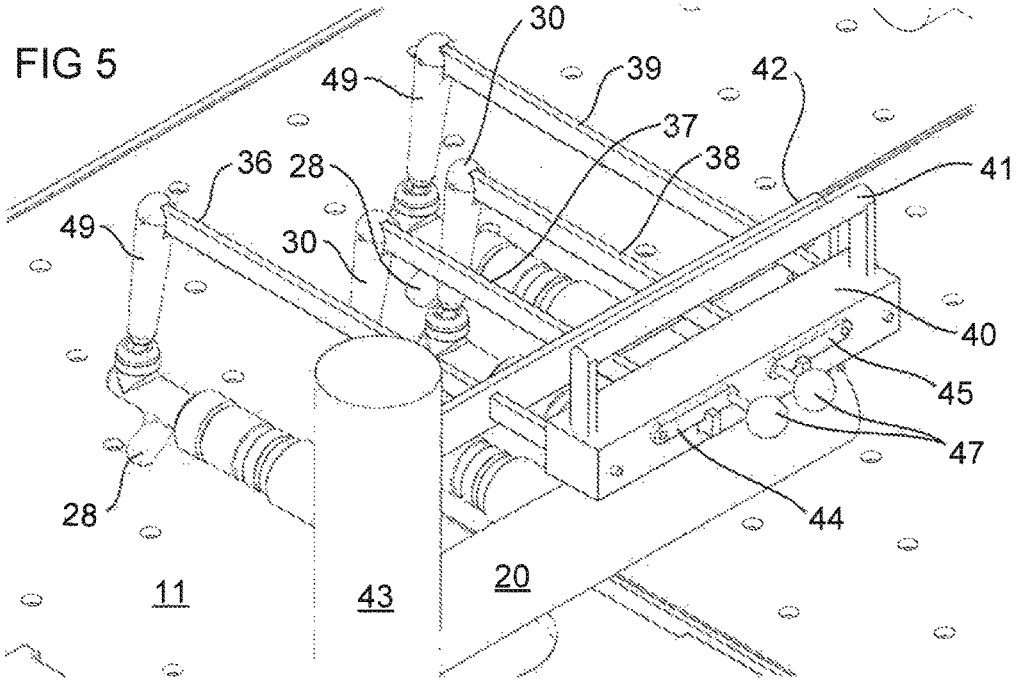
FIG. 5 is a view of one of the beverage dispensing assemblies of FIGS. 1 and 2.

FIG. 5 is a view of the dispensing assembly 20 from the dispense operator side of the dispensing assembly 20 and shows link arms 36 to 39 that extend to taps 28 and 30. The link arms 36 and 39 extend to the front taps 28 and connect to the manifold 40. The manifold 40 includes an upstanding handle 41 that can be used to manually move the link arms 36 and 39 forward and back. Forward movement of the link arms 36 and 39 actuates the taps 28 to dispense beverage while rearward movement terminates beverage flow. The link arms 36 and 39 extend through openings in a horizontal beam 42 which extends from dispensing post 43.

Link arms 37 and 38 extend to the taps 30 and also extend to the manifold 40 through the horizontal beam 42. However, the link arms 37 and 38 are not fixed to the manifold 40 but rather, extend through the manifold 40 to a latching mechanism comprising latches 44 and 45. It can be seen from FIG. 6 that the end of the link arm 37 includes a slot 46 that in FIG. 5, the latch 44 extends into. The link arm 38 also includes the same form of slot and in FIG. 5, the latch 45 extends into that slot. By the arrangement of FIG. 5, the link arms 37 and 38 are fixed relative to the manifold 40 and when the manifold 40 is pushed forward, the link arms 37 and 38 move forward to actuate the taps 30 so that all of the taps 28 and 30 are actuated to dispense beverage.

Figure 6:
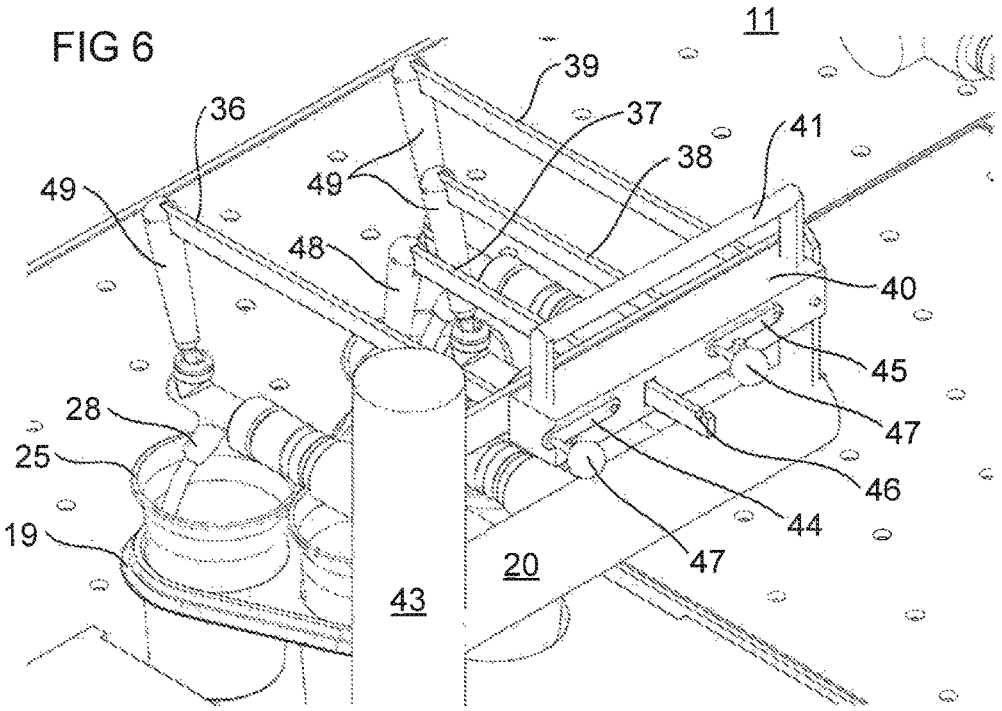
FIG. 6 is a view of the beverage dispensing assembly of FIG. 5 in a pouring mode.

However, the link arms 37 and 38 can be disabled from movement with the manifold 40 by rotating the latches 44 and 45 via the handles 47 and when disabled, movement of the manifold 40 moves the link arms 36 and 39 but the link arms 37 and 38 simply pass through the manifold 40 as it moves forward and back. This sort of arrangement is illustrated in FIG. 6, in which the latch 44 has been rotated out of engagement with the slot 46 of the link arm 37, but the latch 45 has been maintained in engagement with the slot of the link arm 38. It can be seen that forward movement of the manifold 40 in the direction A shifts each of the link arms 36, 38 and 39 forward, but not the link arm 37. The link arm 37 simply passes through the manifold 40 and so the handle 48 which connects to the link arm 37 remains in an off position whereas the handles 49 connected to the other link arms are all moved or rotated forward to a dispensing position.

It will be appreciated that the link arm 38 can be disengaged from the manifold 40 in the same manner as described for the link arm 37 so that both of the link arms 37 and 38 can be disabled from dispensing beverage. The dispense operator of the dispensing assembly 20 has the discretion as to which of the taps 30 and 30 are to be actuated to dispense beverage. Moreover, the latching arrangement described in relation to the link arms 37 and 38 can be applied to the link arms 36 and 39 so that any number of the taps 28 and 30 can be disabled as required.

Accordingly, the invention as illustrated allows the dispensing assembly 20 to dispense between two and four beverage flows from the various dispensing taps 28 and 30. However, the assembly 20 as illustrated is configured so that the dispensing taps 28 always dispense beverage, whereas the dispensing taps 30 can be manipulated so that neither of the taps dispense beverage, or one or both of the taps dispense beverage.

It will also be appreciated that the manual nature of the dispensing assembly 20 can be automated, so that the dispense operator of the dispensing assembly 20 can operate a press button arrangement for example, or can operate switches that determine which of the dispensing taps 28 and 30 dispense beverage.

In relation to the dispensing assembly 20, and with reference to FIG. 3, the assembly 20 has been configured for use with the particular beverage cup carrying container 19 illustrated. The container 19 has two front cups and two rear cups, and in relation to the illustrated embodiment of the dispensing assembly 20, the rear cups $\mathbf{25}_r$ are always intended to be filled, whereas the front cups $\mathbf{25}_f$ are optionally filled according to the latching arrangement discussed above in relation to FIG. 6. Accordingly, for a customer wanting to purchase two drinks, the beverage cups $\mathbf{25}_r$ can be loaded into the carrying container 19, preferably by the dispense operator, but optionally by the customer and the loaded carrying container 19 can be placed in the beverage receiving position of FIG. 3. Alternatively, a customer purchasing three or four cups, would always include the rear beverage cups $\mathbf{25}_r$, in the carrying container 19 and one or both of the beverage cups 25*f*.

For convenience, the carrying container 19 can be prefilled with beverage cups 25 as suggested above and stacked in the stack area 18 (see FIG. 2) of the beverage dispensing arrangement 10 so ready access to prefilled carrying containers 19 is available to the dispense operator. Thus, with reference to FIGS. 1 and 2, a customer can request a carrying container 19 which carries two, three or four cups, and the dispense operator can load a suitably filled container 19 into the beverage receiving position. That is, the dispense operator then can present the loaded carrying container 19 to the dispensing assembly 20 as shown in FIG. 3 for filling the beverage cups $\mathbf{25}_r$ and one or more of the beverage cups $\mathbf{25}_f$. Alternatively, neither of the beverage cups $\mathbf{25}_f$ might be filled. Once filled, the carrying container 19 can be removed by the customer. If the customer is not interested in using a carrying container 19, then the dispensing assembly 21 can be employed as will be described later herein with reference to FIGS. 8 to 11.

An alternative arrangement as discussed above is to have the stack area 18 open to the customers, so that the customers themselves can take a carrying container 19, which is either prefilled, or which is empty and can them be filled with a suitable number of beverage cups 25 by the customer. The beverage cup dispensing tubes 13 could be positioned for convenience to the customer, so that while the customer is waiting in line, he/she can load the carrying container 19 with the desired number of cups 25.

It will be evident that once the beverage cups 25 have been filled, that the customer can take the carrying container 19 away from the dispensing assembly 20 without having to load the beverage cups into another carrying container. This conveniently minimises the opportunity for spillage of beverage from the beverage cups, as it minimises the amount of manipulation of the beverage cups once they are filled. As will be evident from the description of the prior art, prior art arrangements have required beverage cups to be filled and for the customer to manipulate the cups into a carrying container in their filled state. The present invention advantageously eliminates that step, with a consequential reduction in potential spillage.

The template 33 has been described before as providing a convenient way to properly position the carrying container 19 with loaded beverage cups 25 below the dispensing assembly 20. A further advantage provided by the template 33 in some forms of the invention is that the template can be used to shift the carrying container 19 towards the customer once the beverage cups 25 have been filled. With reference to FIG. 2, the template 33 is shown as having a handle 50 and in this arrangement, the template 33 sits on the dispensing bench 11 without being fixed to the bench 11, so that it can slide forward and back within the recess provided by the edges 51 (FIG. 3) of adjacent parts of the dispensing bench 11 of the arrangement 10. This arrangement conveniently allows the operational personnel to push the container 19 forward for convenient grasping by the customer, without the customer having to reach forward and into the path of the dispensing assembly 20. It also allows the operational personnel to control when the container 19 is presented to the customer for removal so that delays in removal are minimised.

Figure 7:
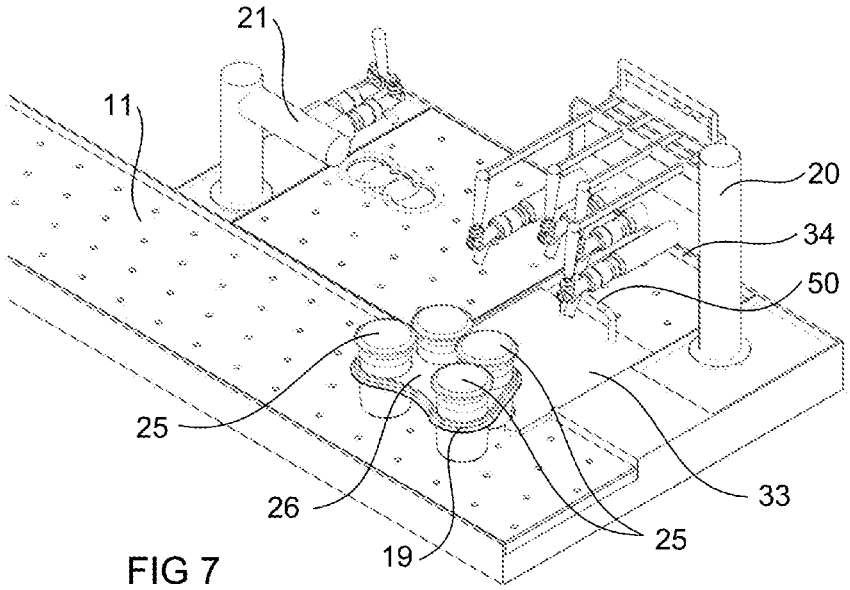
FIG. 7 is a view of the beverage dispensing arrangement of FIG. 4 as showing a cup and carrying container assembly after filling.
Figure 8:
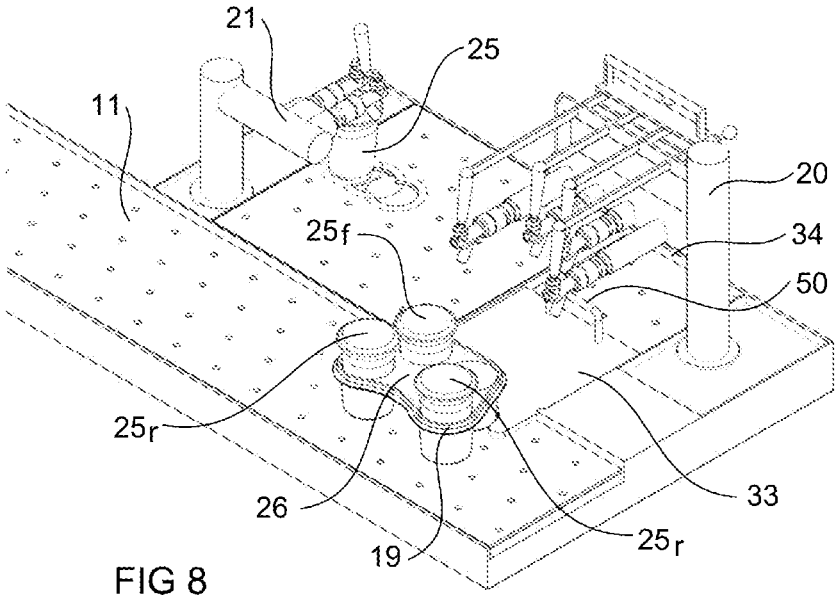
FIG. 8 is a view of the beverage dispensing arrangement of FIG. 4 as showing a cup and carrying container assembly after filling with the second beverage dispensing assembly shown approximate a single beverage cup.

The use of a movable template 33 is illustrated in FIG. 7, which shows the template 33 having been moved forward to push the carrying container 19 and beverage cups 25 in the same direction towards the customer. Likewise, FIG. 8 shows the same arrangement as FIG. 7, but with the container 19 including only three beverage cups, so that one of the forward beverage cups $\mathbf{25}_f$ has not been loaded into the container 19. This figure also illustrates that the carrying container 19 includes four receptacles for beverage cups 25 with only three of the receptacles filled with beverage cups. It will be apparent from FIG. 8 that the engagement with the template 33 is by the base of the receptacles of the carrying container 19 rather than with the beverage cups 25 themselves.

Figure 11:
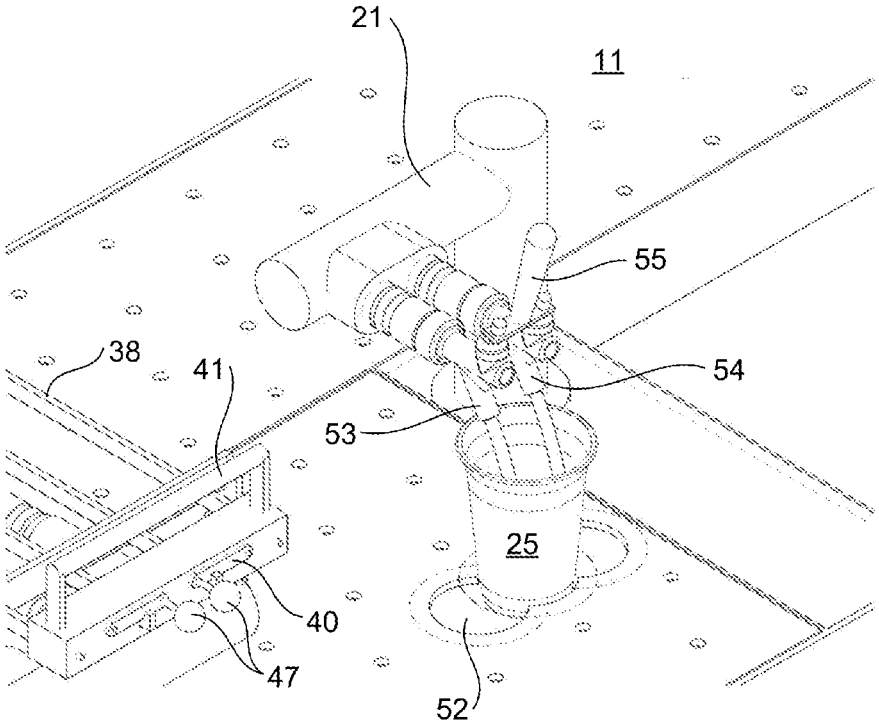
FIG. 11 shows the second beverage dispensing assembly in a pouring mode with single beverage cup being filled.

The present invention also provides the dispensing assembly 21, which is shown in several of the figures and which is associated with a recess 52 formed in the dispensing bench 11. With reference to FIG. 4, the recess 52 is formed to receive the base of a further pair of beverage cups 25 as shown in FIGS. 9 and 10, or a single beverage cup 25 as shown in FIG. 11. In FIG. 9, the beverage cups 25 are shown side by side in the recess 52, while in FIG. 11, a single beverage cup 25 is shown located centrally of the recess 52. FIG. 9 also shows the carrying container 19 twice, with one carrying container 19 including two rear beverage cups $\mathbf{25}_r$ and one front cup $\mathbf{25}_f$, while the front carrying container 19 includes just two rear beverage cups $\mathbf{25}_r$. This shows the range of options for the dispensing assembly 20 to fill two, three or four beverage cups 25, although it is to be appreciated that the two carrying containers 19 are shown adjacent each other purely for illustrative purposes and it is not intended that in use, carrying containers 19 would be positioned on the dispensing bench 11 in the manner shown.

The dispensing assembly 21 is provided so that the beverage dispensing arrangement 10 has facility for filling one or two beverage cups without the need for a container 19 but still in a convenient manner. Thus, while a customer could place a pair of beverage cups beneath the relevant dispensing taps 28 and 30 of the dispensing assembly 20 without the use of a carrying container 19, the alternative is for the customer to simply ask the dispense operator for one or two beverage cups to be filled and the dispense operator could use the dispensing assembly 21 for that purpose. The dispense operator thus could pull one or two beverage cups from the dispensing tubes 13 and use the manual handle 55 of the dispensing assembly 21 to pour the beverage.

It is to be noted that FIG. 8 shows the single beverage cup 25 in place prior to the second beverage cup being located within the recess 52 next to the first cup. However, it is not intended that the dispensing assembly 21 be used to fill the single beverage cup 25 of FIG. 8 in the position shown as will be apparent from the discussion that follows.

The shape of the recess 52 is intended to provide for filling a single beverage cup 25, or two beverage cups 25. This is illustrated in FIGS. 10 and 11, which in FIG. 10, shows a pair of beverage cups being filled through the taps 53 and 54 of the dispensing assembly 21, whereas in FIG. 11, the single beverage cup 25 is being filled by both of the dispensing taps 53 and 54. By this arrangement, the pair of taps 53 and 54 can always be used to fill a beverage cup 25 regardless of whether two of the cups 25 are within the recess 52 or a single cup. In each case, the taps 53 and 54 are linked together and are manually operated by the one handle 55 although as indicated for the dispensing assembly 20, automatic or semi-automatic arrangements could be employed rather than the tap handle 55.

The invention can be embodied in the form of a portable, self-contained unit which is transportable on casters 57 (see FIGS. 1 and 2), or it could be embodied in a bench style arrangement such as shown in FIG. 3. That is, the FIG. 3 arrangement could be provided for use with existing benches, rather than being provided as a self-contained unit of the kind shown in FIGS. 1 and 2. Moreover, it should be appreciated that the separate dispensing assemblies 20 and 21 can be provided separately and are not required to be provided together or with a dispensing bench. That is, the invention extends to the dispensing assemblies 20 and 21 as separate and independent units. However, advantages flow from the use of the dispensing assemblies 20 and 21 together as discussed above and as combined with other components of a dispensing arrangement 10 as illustrated.

Figure 12:
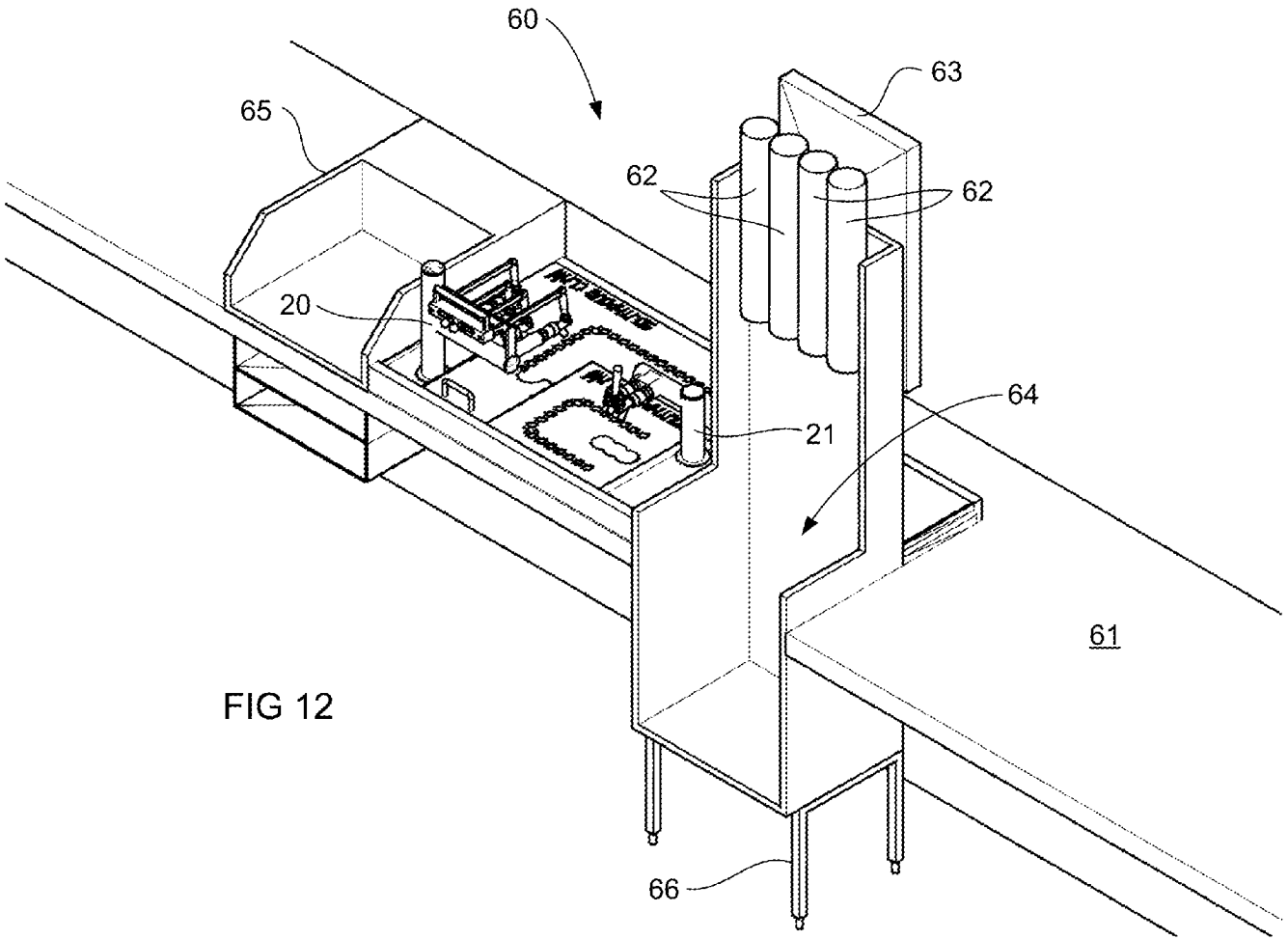
FIG. 12 shows a view of an embodiment of the beverage dispensing arrangement and bar.
Figure 13:
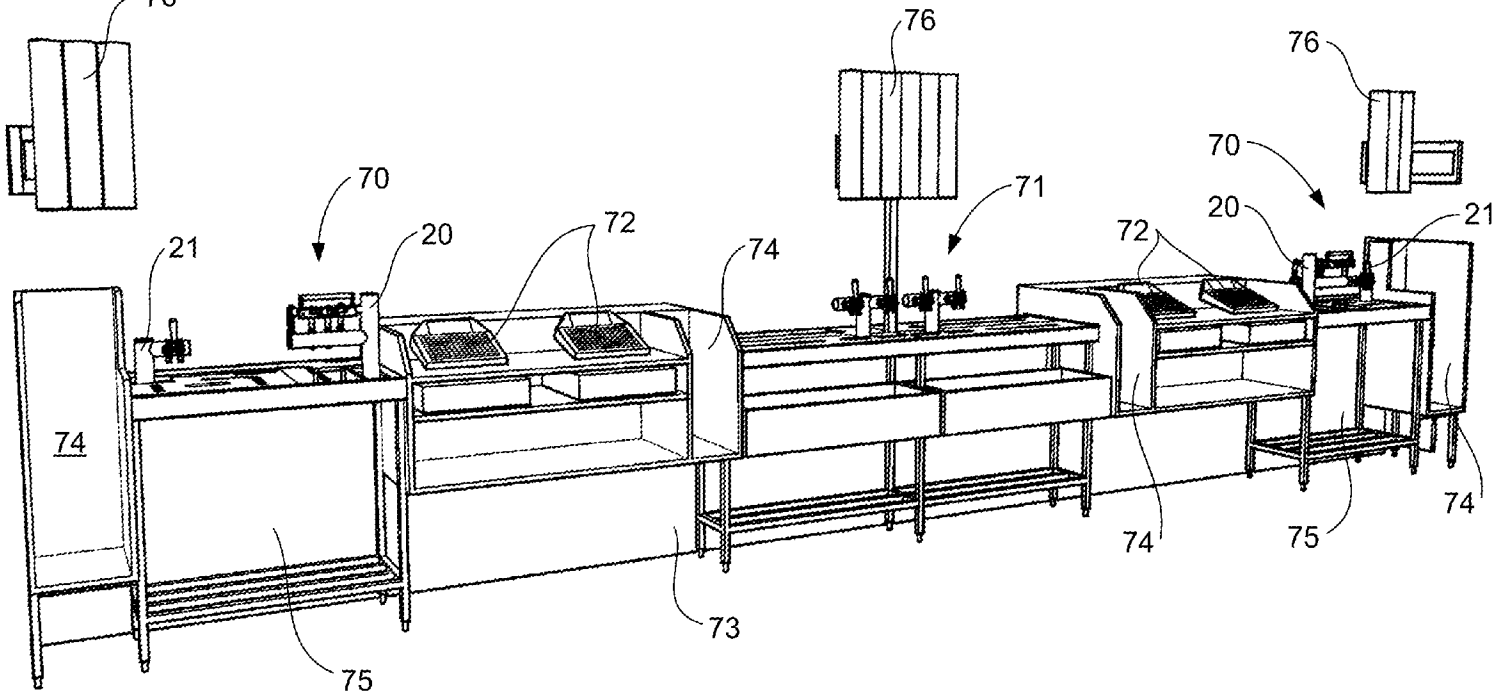
FIG. 13 shows a rear or operator side view of an embodiment of the beverage dispensing arrangement and bar having a greater length bar.
Figure 14:
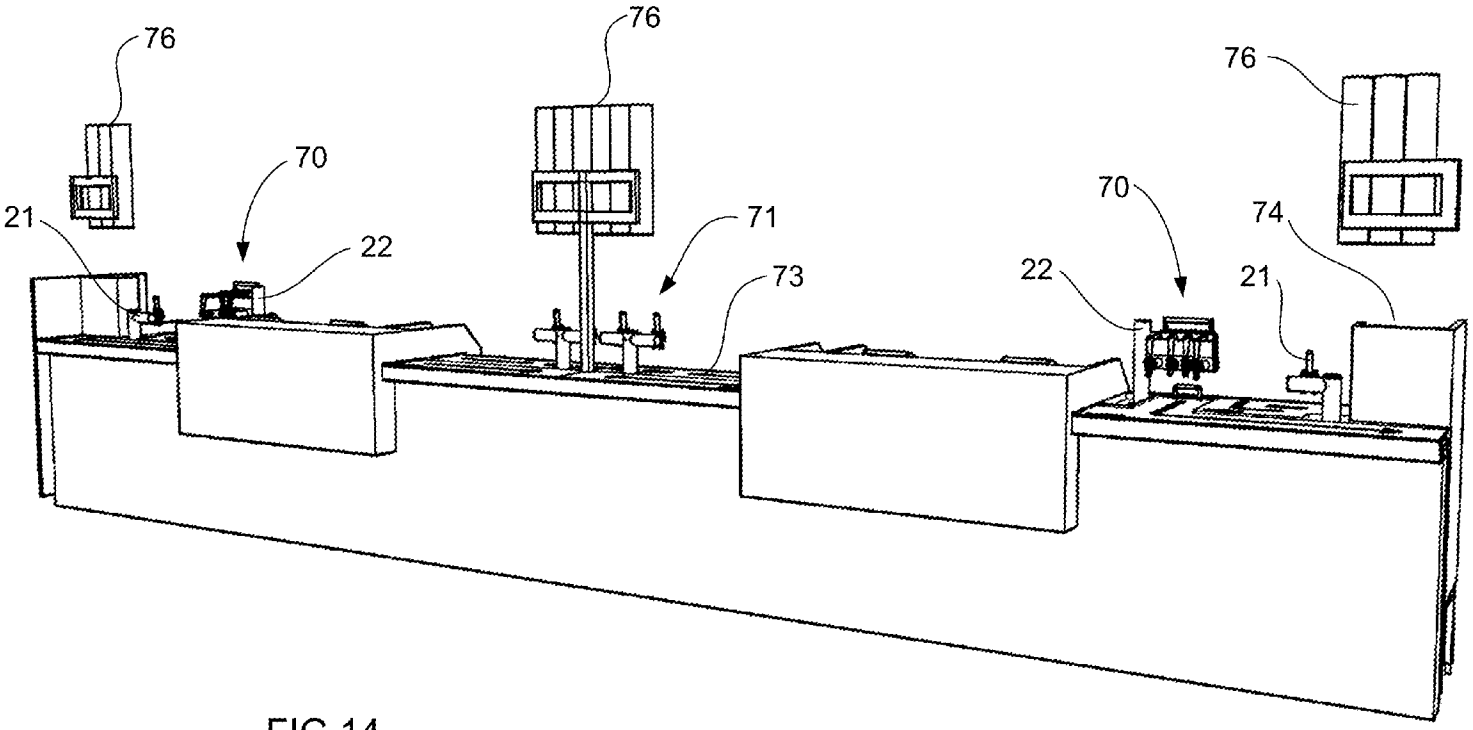
FIG. 14 shows a front or user side view of an embodiment of the beverage dispensing arrangement and bar having a greater length bar.

While it is likely to be relatively clear to a person skilled in the art as to how the present invention could be incorporated into an existing workbench, or into a fixed bench style installation, FIGS. 12 to 14 provide an example of this alternative form of the invention. With reference to FIG. 12, a beverage dispensing arrangement 60 is illustrated which is installed as a permanent fixture in a workbench or bar 61. The arrangement 60 includes the beverage dispensing assemblies 20 and 21 of the beverage dispensing arrangement 10 and these operate in the same manner as described in relation to the beverage dispensing arrangement 10. Accordingly, further discussion in relation to the operation of the beverage dispensing arrangement 60 is not required. The arrangement 60 is viewed from the dispense operator side, which is the view from the same side as shown in FIG. 2.

Other features shown in FIG. 12 include beverage cup dispensing tubes 62, signage 63 and a stock area 64, which in FIG. 12 is shown empty.

The arrangement 60 further includes cabinetry 65 to house a point of sale cash register and is supported periodically on legs 66 for the length of the bar 61.

With reference to FIGS. 13 and 14, a greater length of bench or bar is illustrated which includes beverage dispensing arrangements 70 according to the invention, along with beverage dispensers 71, which are twin versions of the dispensing assemblies 21. That is, the dispensing assemblies 21 shown in various earlier figures include taps 53 and 54 operated by a handle 55. The dispensing assemblies 21 extend on one side only of a vertical supporting post. However, the beverage dispensers 71 include a symmetrical arrangement in which pairs of taps are positioned on either side of the supporting post. This arrangement further increases the variations available in the present invention to improve the speed of beverage delivery. FIG. 13 shows the beverage dispensing arrangements 70 from the dispense operator side, while FIG. 14 shows them from the customer side.

The beverage dispensing arrangement 70 continues to include the beverage dispensing assemblies 20 and 21 of the earlier figures, and further includes point of sale cash registers 72 mounted within an elongate bench or bar 73 and includes stock area 74 and under counter storage 75. Cup dispensing tubes 76 are either fixed to wall surfaces or posts (not shown) for elevation above the bar 73.

Without needing to go into significant description of the beverage dispensing arrangements 60 and 70, it can be seen that the invention can be embodied in a fixed installation, and it can further be seen that the present invention can be integrated with prior art beverage dispensing arrangements if required.

The invention can also readily be embodied in arrangements that employ different cup carrying containers to the container 19 illustrated. For example, a different type of cup carrying container has a circular form with four equidistantly spaced openings for four beverage cups. Thus, the cups are arranged in a circular formation rather than the stepped formation of the container 19. A different array of dispensing taps can be arranged for filling cups presented in that formation. A further different type of cup carrying container has a square assembly for four cups whereby a front pair of two cups is located immediately in front of a rear pair of two cups. Again, a different array of dispensing taps can be arranged for filling cups presented in that formation. Thus, it will be appreciated that the form of carrying container can vary from that illustrated and still be accommodated by the present invention.

The dispensing assembly 21 has been described as including four dispensing taps 28 and 30 but it should be appreciated that a greater or lesser number of taps could be provided. For example, two or three taps could be provided as could five or six taps. The taps could be selectively operable depending on the number of beverage cups presented at any time. The number of taps could depend on the type of cup carrying containers the beverage dispensing arrangement is to be used with.

A major benefit that the present invention is expected to provide relates to a better and more efficient customer experience and interaction. The elimination of double handling of filled beverage cups is an important advantage provided by the invention, but in addition, the arrangement of FIGS. 1 to 3 in which the customer faces the dispensing taps, rather than the operational personnel is also considered important as providing a cleaner more efficient manner of dispensing beverage to the customer. The operational personnel have no contact with the filled beverage cups whatsoever, and by that method, efficiencies in serving speed are achieved as well as obvious improvements in hygiene.

Another advantage of the invention is that beer is poured on demand rather than pre-poured as with the prior art arrangements discussed above and utilising semi-automatic pouring systems. This has benefits in terms of beverage freshness and personalised service which can significantly improve the customer experience. This also has benefits for the beverage supplier who wants beverage to be presented in best possible condition.

The invention described herein is susceptible to variations, modifications and/or additions other than those specifically described and it is to be understood that the invention includes all such variations, modifications and/or additions which fall within the spirit and scope of the present disclosure.

The invention claimed is:

1. A beverage dispensing arrangement for dispensing beverage into beverage cups that are secured within a beverage cup carrying container and which form a cup and carrying container assembly, the arrangement including a dispensing bench on which a cup and carrying container assembly can be supported, a beverage dispensing assembly for dispensing beverage into the cups of a cup and carrying container assembly and including at least two dispensing taps that are spaced apart relative to the spacing of the cups of the cup and carrying container assembly to overlie the open ends of the cups when the cup and carrying container assembly is placed in a beverage receiving position, the beverage dispensing arrangement having an operator side and a customer side which are on opposite sides of the dispensing arrangement, the beverage dispensing arrangement being such that a customer or an operator has access to the beverage receiving position from the customer side and upon placement by the customer or an operator of the cup and carrying container assembly in the beverage receiving position an operator is able to operate the dispensing taps from the operator side to dispense beverage into the cups of the cup and carrying container assembly, for removal of the assembly by the customer or an operator upon the cups of the cup and carrying assembly being filled.

2. The beverage dispensing arrangement of claim 1, the beverage dispensing assembly including four taps arranged side by side forming a pair of outside taps and a pair of inside taps, the outside taps being positioned closer to the customer side than the inside taps.

3. The beverage dispensing arrangement of claim 1, the beverage dispensing assembly including four taps whereby two of the taps can be selectively disabled so that of the four taps, beverage can be selectively dispensed from two, three or four of the taps.

4. The beverage dispensing arrangement of claim 1, the dispensing taps including a handle which operates a valve in each tap to open or close the tap to flow of beverage, each handle being connected by a rod to a manifold whereby movement of the manifold in a forward direction away from the operator side moves each of the rods forward to actuate the handles of the taps to open the tap valves to dispense beverage from the taps.

5. The beverage dispensing arrangement of claim 4, the rods being disengageable from the manifold so that movement of the manifold in the forward direction can selectively move less than all of the rods in the forward direction.

6. The beverage dispensing arrangement of claim 5, the beverage dispensing assembly including four dispensing taps and the rods that extend from two of the taps being disengageable from the manifold.

7. The beverage dispensing arrangement of claim 1, further including a second beverage dispensing assembly, which includes at least one dispensing tap.

8. The beverage dispensing arrangement of claim 7, the second beverage dispensing assembly including two taps which are spaced apart an amount so that beverage flow from the taps can be made into a single beverage cup or into two adjacent beverage cups.

9. The beverage dispensing arrangement of claim 8, the dispensing bench including a recess to locate beverage cups in a position so that the taps of the second beverage dispensing assembly overlie a single beverage cup or two adjacent beverage cups.

10. The beverage dispensing arrangement of claim 1, including an abutment that the cup and carrying container assembly can abut in the beverage receiving position.

11. The beverage dispensing arrangement of claim 10, the abutment being movable from the operator side so that upon the cups of the cup and carrying container assembly being filled with beverage, the operator can shift the abutment towards the customer side so as to push the cup and carrying container assembly in the same direction.

12. The beverage dispensing arrangement of claim 10, including guide surfaces that guide movement of the cup and carrying container assembly on the dispensing bench to the beverage receiving position.

13. The beverage dispensing arrangement of claim 12, the guide surfaces being arranged to engage bottom ends of receptacles of the cup and carrying container assembly in which the beverage cups of the cup and carrying container assembly are secured or bottom ends of the beverage cups of the cup and carrying container assembly.

14. The beverage dispensing arrangement of claim 1, including a cabinet on which the dispensing bench is located.

15. The beverage dispensing arrangement of claim 1 including a beverage dispensing assembly.

16. A method of dispensing beverage into beverage cups, the method including placing at least two cups in a handheld beverage cup carrying container to form a cup and carrying container assembly, placing the cup and carrying container assembly in a beverage receiving position relative to a beverage dispensing arrangement, the beverage dispensing arrangement including at least two dispensing taps that are spaced apart to overlie the open ends of the beverage cups of the cup and carrying container assembly when the cup and carrying container assembly is in the beverage receiving position, activating the beverage dispensing arrangement to dispense beverage into the beverage cups of the cup and carrying container assembly and, upon the beverage cups being filled, removing the cup and carrying container assembly from the beverage dispensing arrangement, the beverage dispensing arrangement having an operator side and a customer side such that once the cup and carrying container assembly is placed in the beverage receiving position, the beverage dispensing arrangement is operated from the operator side, and once the cups of the cup and carrying container assembly are filled with beverage, the cup and carrying container assembly is removed from the customer side.

* * * * *